US005609112A

United States Patent [19]

Meyer et al.

[11] Patent Number: 5,609,112

[45] Date of Patent: Mar. 11, 1997

[54] TABLE WITH BRACKET-SUPPORTED REAR PANEL

[75] Inventors: Kevin L. Meyer, Hudsonville, Mich.; Roberto G. Fraquelli, London, England

[73] Assignee: Haworth, Inc., Holland, Mich.

[21] Appl. No.: 488,490

[22] Filed: Jun. 8, 1995

[51] Int. Cl.[6] ..... A47B 3/06

[52] U.S. Cl. ..... 108/153

[58] Field of Search ..... 108/50, 153, 152, 108/90, 97, 98, 182; 312/257.1, 195, 196, 263, 265.5; 248/250, 235, 225.11

[56] References Cited

U.S. PATENT DOCUMENTS

| | | | |
|---|---|---|---|
| D. 321,102 | 10/1991 | Newhouse . | |
| D. 321,447 | 11/1991 | Newhouse . | |
| D. 325,309 | 4/1992 | Worrell . | |
| D. 330,302 | 10/1992 | Heidmann . | |
| 2,942,924 | 6/1960 | Stangert | 312/196 X |
| 3,748,006 | 7/1973 | Levit et al. | 312/196 |
| 4,733,843 | 3/1988 | Bessinger | 248/250 |
| 4,884,513 | 12/1989 | Newhouse et al. . | |
| 5,083,512 | 1/1992 | Newhouse et al. . | |
| 5,094,174 | 3/1992 | Grund et al. . | |
| 5,103,741 | 4/1992 | Grund et al. . | |
| 5,154,126 | 10/1992 | Newhouse et al. . | |
| 5,160,188 | 11/1992 | Rorke et al. . | |
| 5,183,319 | 2/1993 | Pearson et al. . | |
| 5,226,705 | 7/1993 | Rorke et al. . | |
| 5,237,935 | 8/1993 | Newhouse et al. . | |
| 5,456,435 | 10/1995 | Sweeney | 248/250 |
| 5,486,042 | 1/1996 | Heisler et al. | 312/196 |
| 5,509,634 | 4/1996 | Gebka et al. | 248/250 X |

OTHER PUBLICATIONS

"The Teknion Office System—TeknionTwo—Panel System and Desk System" brochure, Teknion Furniture Systems, (8 pages).

Haworth "Furniture That Works—Office Desking System" brochure, Haworth, Inc., 1994 (4 pages).

Steelcase "Ellipse Desk System" Product Overview brochure, Steelcase Inc., 1994, (22 pages).

Steelcase "Ellipse Desk System" Product Overview appearance performance brochure, Steelcase Inc., (14 pages).

Steelcase Inc. "The art of working brings you . . . unlimited possibilities" Ellipse brochure, (11 pages).

Various pages (8 pages) from Krueger Price List Guide for various "WorkZone" products.

Herman Miller "Newhouse Group Furniture" brochure, Herman Miller, Inc., 1988, (12 pages).

Herman Miller "Newhouse Group Furniture" Planning Information brochure, Herman Miller, Inc., 1988, (62 pages).

*Primary Examiner*—Jose V. Chen

*Attorney, Agent, or Firm*—Flynn, Thiel, Boutell & Tanis, P.C.

[57] ABSTRACT

A table or desk is provided with a horizontally enlarged worksurface, and a bracket-supported rear panel arrangement can be readily mounted to a project upwardly along a rear edge of the worksurface. The panel arrangement includes a pair of upright brackets which have C-shaped lower parts which create a clamping engagement around the rear edge of the worksurface so that special constructional features on the worksurface are not required. The brackets have upright parts which project upwardly and, along rear vertical edges thereof, have attachment structure for permitting an upright panel to be attached thereto, which panel is then disposed directly adjacent the rear edge of the worksurface and projects upwardly and longitudinally thereof. The bracket includes first and second attachment structures associated therewith, with one attachment structure permitting a grid-like panel to be mounted thereon. Alternatively, or in conjunction with the grid-like panel, the second attachment structure permits a privacy screen or tack board to be attached to the brackets, the latter being spaced rearwardly of the location where the grid-like panel mounts.

21 Claims, 4 Drawing Sheets

TABLE WITH BRACKET-SUPPORTED REAR PANEL

FIELD OF THE INVENTION

This invention relates to a table having an improved bracket structure removably attached to the rear edge thereof for detachable support of an upright panel adjacent the rear of the worksurface.

BACKGROUND OF THE INVENTION

Office and educational environments make extensive use of tables, particularly freestanding tables, for defining working or training stations. The demand for increased storage space for accessories and supplies, and/or the need for greater privacy, however, have resulted in many prior tables of this type being modified to permit mounting of an upright support adjacent the rear edge of the worksurface so as to mount either an upright privacy screen and/or accessories which support or mount supplies or the like. These prior attempts have primarily involved the provision of an upright rail or support arrangement which has required support legs which fixedly attach to the worksurface, with the worksurface often being provided with special mounting hardware recessed therein for fixedly attaching the legs of the mounting rail. Arrangements of this type are disadvantageous, however, since not only does the attachment or detachment of the rail from the worksurface require a greater effort because of the mechanical connections involved, but the construction of the worksurface requires special manufacturing manipulations and special parts which increase the cost and complexity of the worksurface, and which detract from the appearance of the worksurface when the upright support rail is not utilized.

It is an object of this invention to provide a table or desk which optionally permits an upright rear panel to be readily mounted on or removed from the worksurface adjacent the rear edge thereof, which arrangement overcomes disadvantages of the type mentioned above inasmuch as the upright panel arrangement of this invention can be easily and effectively mounted on or removed from the rear edge of the worksurface without complex mechanical manipulations, and the arrangement can be mounted on the worksurface without requiring any special constructional features of the worksurface so as to simplify the manufacture thereof.

Briefly, according to the present invention, a table or desk is provided with a horizontally enlarged worksurface, and a bracket-supported rear panel arrangement can be readily mounted to a project upwardly along the rear edge of the worksurface. The arrangement includes a pair of upright brackets which have lower parts which create a clamping engagement around the rear edge of the worksurface so that special constructional features on the worksurface are not required. The brackets have upright parts which project upwardly and, along rear vertical edges thereof, have attachment structure for permitting an upright panel to be attached thereto, which panel is then disposed directly adjacent the rear edge of the worksurface and projects upwardly and longitudinally thereof. The bracket includes first and second attachment structures associated therewith, with one attachment structure permitting a grid-like panel to be mounted thereon, which grid-like panel in turn accommodates mounting of other accessories thereon. Alternatively, or in conjunction with the grid-like panel, the second attachment structure permits a privacy screen or tack board to be attached to the brackets, the latter being disposed so as to be spaced somewhat rearwardly of the location where the grid-like panel is mounted, if utilized.

Other objects and purposes of the invention will be apparent to persons familiar with structures of this general type upon reading the following specification and inspecting the accompanying drawings.

Figure 1:
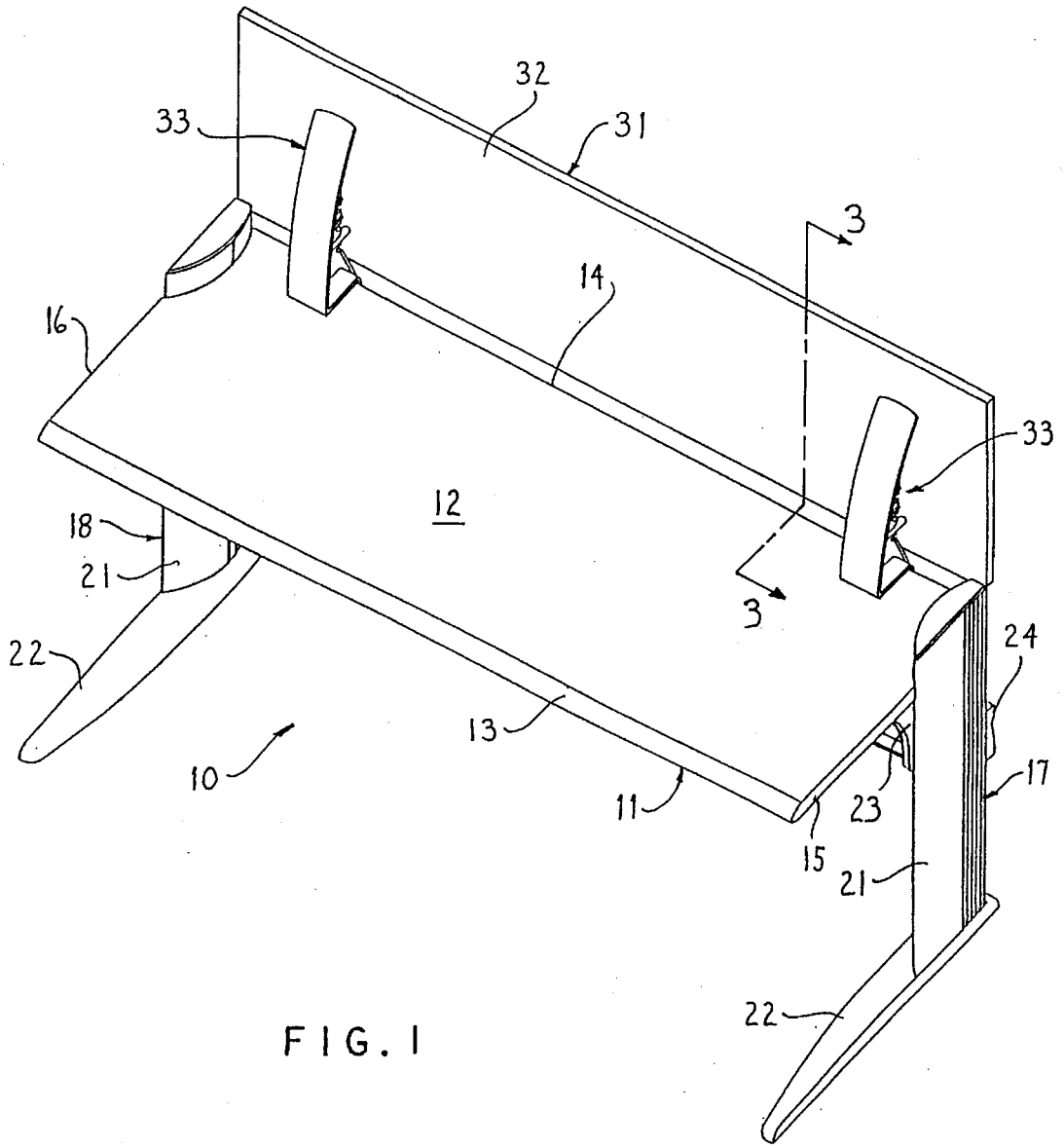
FIG. 1 is a perspective view of a table or desk mounting thereon a bracket-supported rear panel arrangement according to the present invention.
Figure 5:
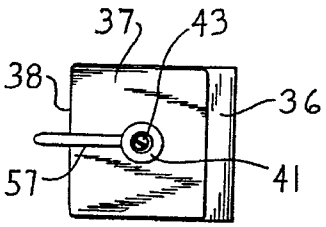
FIG. 5 is a bottom view of the bracket.
Figure 4:
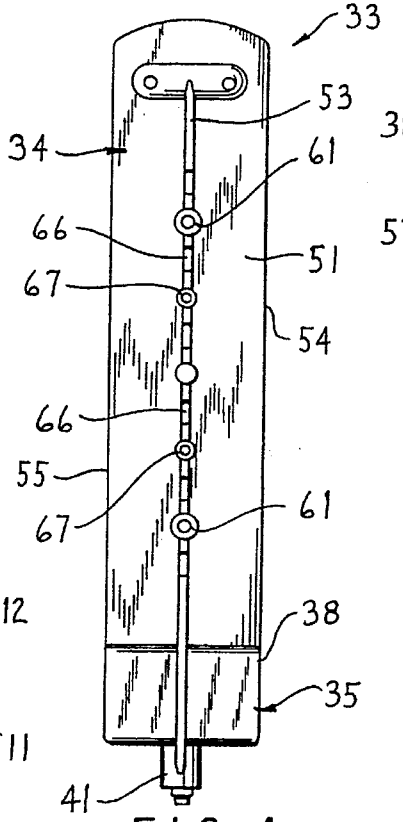
FIG. 4 is a rear elevational view of the bracket shown in FIG. 3.

Certain terminology will be used in the following description for convenience in reference only, and will not be limiting For example, the words "upwardly", "downwardly", "leftwardly" and "rightwardly" will refer to directions in the drawings to which reference is made. The words "upwardly" and "downwardly" will also refer to the normal geometric orientation of the table when in a position of use. The word "front" will refer to the edge of the table closest to the user, and the word "rear" will refer to the edge of the table remote from the user. The words "right" and "left" will also refer to those directions as viewed by the user when positioned adjacent the front edge of the table. The words "inwardly" and "outwardly" will refer to directions toward and away from, respectively, the table and the bracket-mounted panel arrangement and designated parts thereof. Said terminology will include the words specifically mentioned, derivatives thereof, and words of similar import.

DETAILED DESCRIPTION

According to the present invention, and referring specifically to FIG. 1, there is illustrated a desk or table 10 having a horizontally enlarged plate-like top or worksurface 11 which defines thereon a horizontally enlarged and substantially planar upper surface 12. This worksurface 11 has, in the illustrated embodiment, generally parallel and longitudinally extending front and rear edges 13 and 14 respectively, which are transversely joined by right and left end edges 15 and 16 respectively.

The worksurface 11 is supported in upwardly spaced relation from a support surface, such as a floor, by right and left leg assemblies 17 and 18 which are fixed The bottom wall 37 of the base part 35 has a support hub 41 fixed thereto and projecting downwardly therefrom. This hub has an internally threaded opening extending vertically therethrough in which a threaded shaft of a rotatable clamping or pressing member 42 is disposed. This champing member 42 has an enlarged engagement pad 43 on the upper end thereof which is positioned just above the lower wall 37. The lower exposed end of the shaft 42 has a tool-engaging head 44 adapted for engagement with a screw driver or wrench for permitting rotation of the clamping member to cause the head 44 to be moved upwardly into engagement with the bottom surface 19 of the worksurface 11 to cause clamping thereof against the top wall 36.

Considering now the structure of the upright part 34 of the bracket 33, same includes a front wall 51 which at its lower end is joined to the top wall 36 and projects vertically upwardly so as to terminate at a free tip end 52. The front wall 51 in this embodiment is, in the transverse or longitudinal direction of the table, of a flat but thin plate-like configuration, with the wall having a gradual convex curvature so that it angles rearwardly as it projects upwardly.

The front wall 51 in turn has an upright support wall 53 fixed to a rear side thereof in generally transverse relationship thereto. This support wall 53 is a generally thin plate-like, vertically oriented wall which, in conjunction with the front wall 51, defines a generally T-shaped horizontal cross-section.

The upright support wall 53 terminates in a free rear or back edge 56. This upright support wall 53 also has, at its lower end, a generally L-shaped part 57 which projects rearwardly of and downwardly past the rear wall 38, and then wraps under and projects forwardly along the bottom wall 37 for merger with the hub 41. The rear edge 56 of this upright wall, throughout the majority of the height thereof, is to an projected downwardly from the worksurface adjacent opposite ends thereof. The leg assemblies 17 and 18 are substantially identical except for mirror images of one another, and each includes an upright leg 21 which at its lower end is fixed to a horizontally elongate foot 22 which engages the floor. The leg 21 at its upper end is fixed to the worksurface, such as by means of an intermediate support arm 23.

The construction of the table or desk as briefly described above is for example only, and it will be appreciated that the table or desk may assume many other shapes and constructional features which are conventional.

The table 10 supports thereon an upright bracket supported panel arrangement 31 which mounts adjacent the rear edge of the worksurface 11 and projects upwardly therefrom. This panel arrangement 31 includes, in the variation illustrated in FIGS. 1–5, includes an upright panel 32 which is formed as a privacy screen, the latter being supported from the worksurface 11 by a pair of substantially identical but longitudinally spaced brackets 33.

The bracket 33, as shown in FIGS. 2–5, is formed generally as a one-piece member having an upright part 34 joined to a C-shaped base part 35 which functions to clampingly engage a rear edge portion of the worksurface 11.

This C-shaped base part 35 includes generally parallel top and bottom walls 36 and 37 which extend horizontally and are rigidly joined by a vertically extending rear or base wall 38. These latter walls cooperate to define a channel 39 therebetween, which channel opens longitudinally of the table and is open on the front side thereof so that a rear edge portion of the worksurface 11 can be positioned therein, as illustrated by FIG. 3. disposed above the worksurface and is located approximately in vertical alignment with the rear edge 14 of the worksurface.

Figure 7:
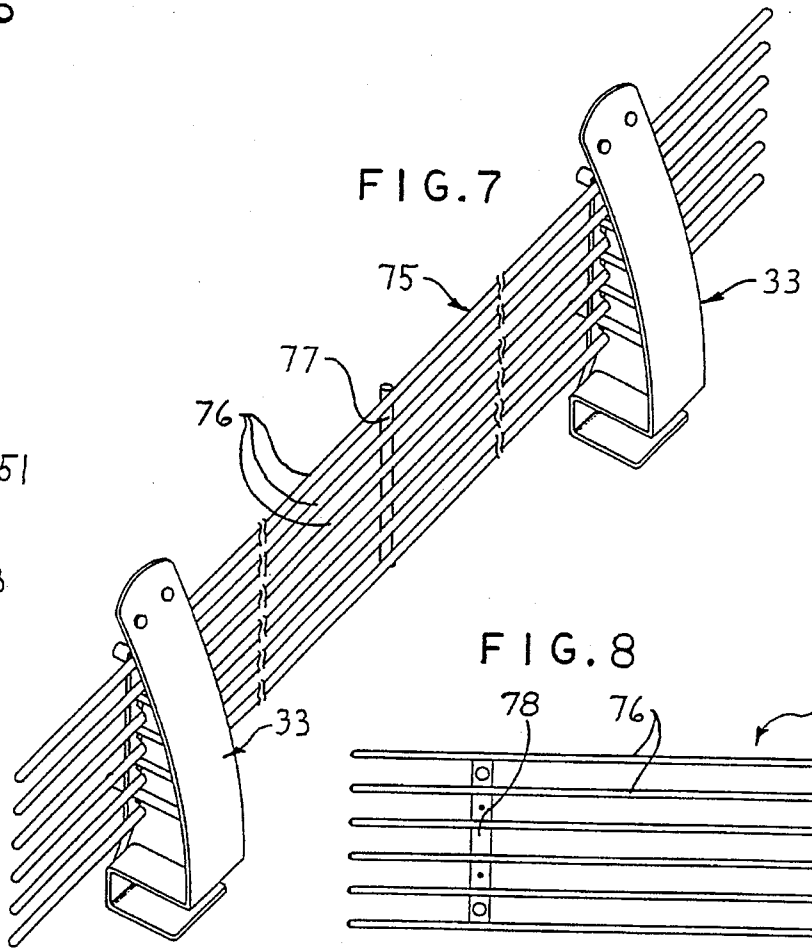
FIG. 7 is a perspective view showing the variation of FIG. 6 wherein the rear panel is defined by a grid.
Figure 8:
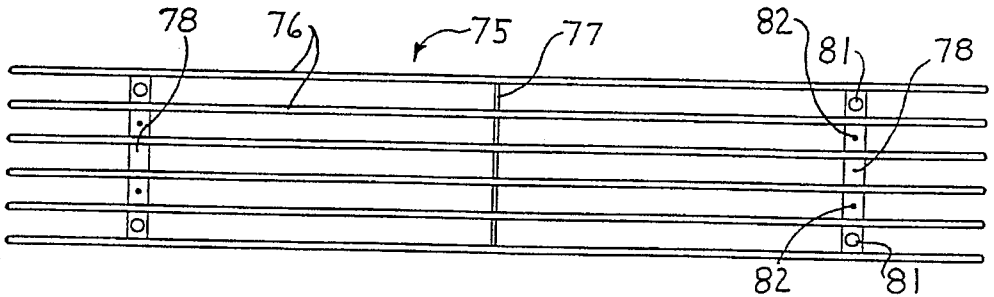
FIG. 8 is a front elevational view of the grid of FIGS. 6 and 7.
Figure 6:
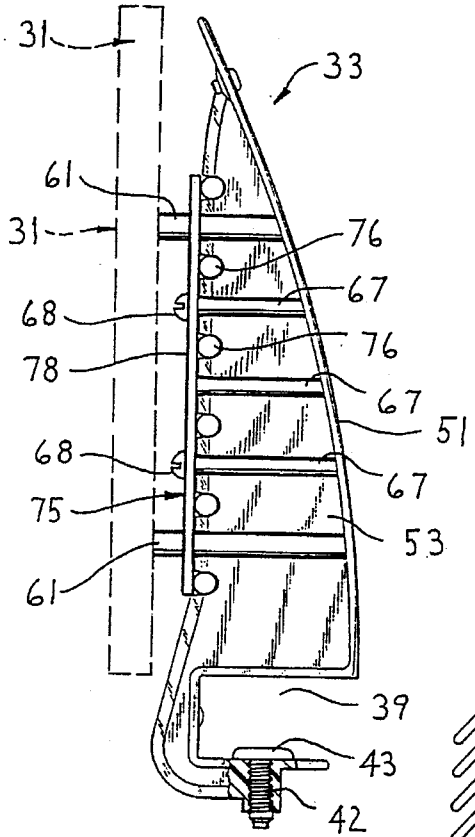
FIG. 6 is a view similar to FIG. 3 but illustrating a variation of the invention.
Figure 10:
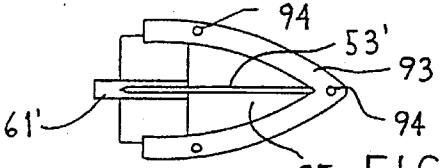
FIG. 10 is a top view of the bracket of FIG. 9.
Figure 11:
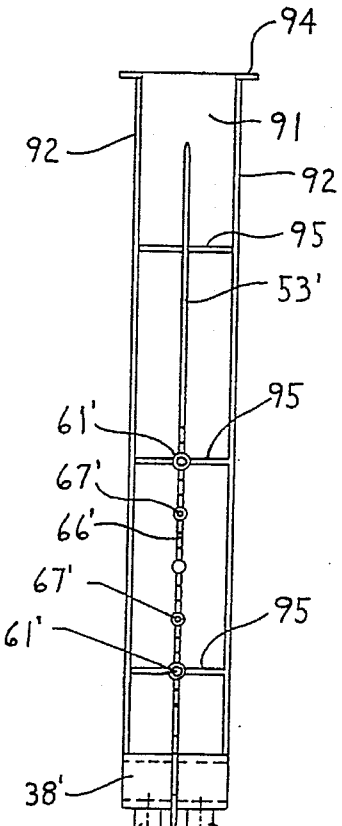
FIG. 11 is a rear elevational view of the bracket of FIG. 9.
Figure 12:
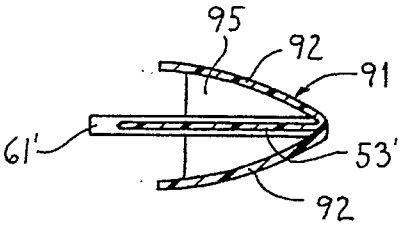
FIG. 12 is a sectional view taken generally along line 12—12 in FIG. 9.
Figure 9:
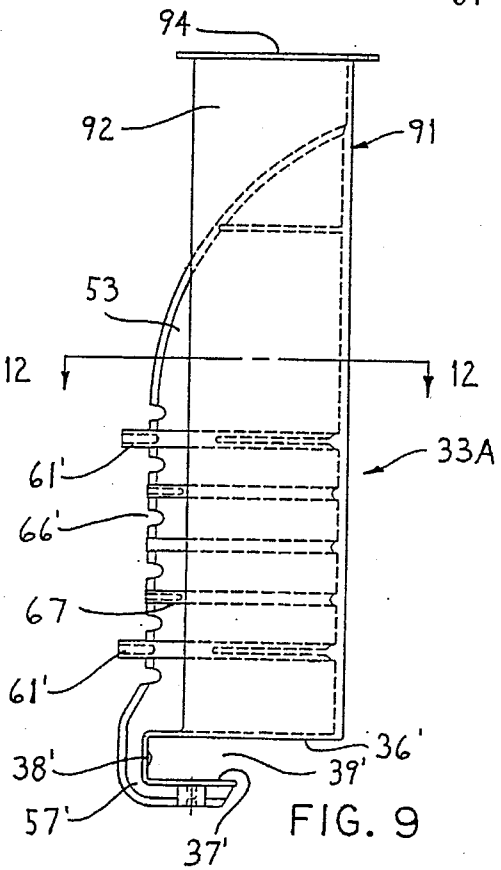
FIG. 9 is a side elevational view of a modified upright bracket for mounting a panel according to the present invention.

The upright support wall 53 defines thereon first and second attachment structures which permit attachment to two different types of upright panels, namely a screen-type panel such as the panel 31 illustrated in FIGS. 1 and 3, and a grid-like panel 75 as illustrated by FIGS. 6–8 and as described hereinafter.

The first attachment structure associated with the upright support wall 53 includes a vertically spaced pair of generally parallel and horizontally rearwardly extending support studs or hubs 61 which project horizontally rearwardly of the upright wall and are cantilevered outwardly a limited distance beyond the rear edge 56 so as to terminate at rear free ends 62. These studs 61 have openings therein which open inwardly from the rear free ends thereof, and fasteners such as screws 63 are disposed so as to extend through suitable openings 64 formed through the screen 31 so as to effect securement of the screen 31 between the screw heads and the end surfaces 62 on the studs. This results in the screen 31 being oriented generally vertically so that the front face 73 thereof is vertically oriented and faces forwardly of the table from a location adjacent the rear edge of the worksurface.

Figure 3:
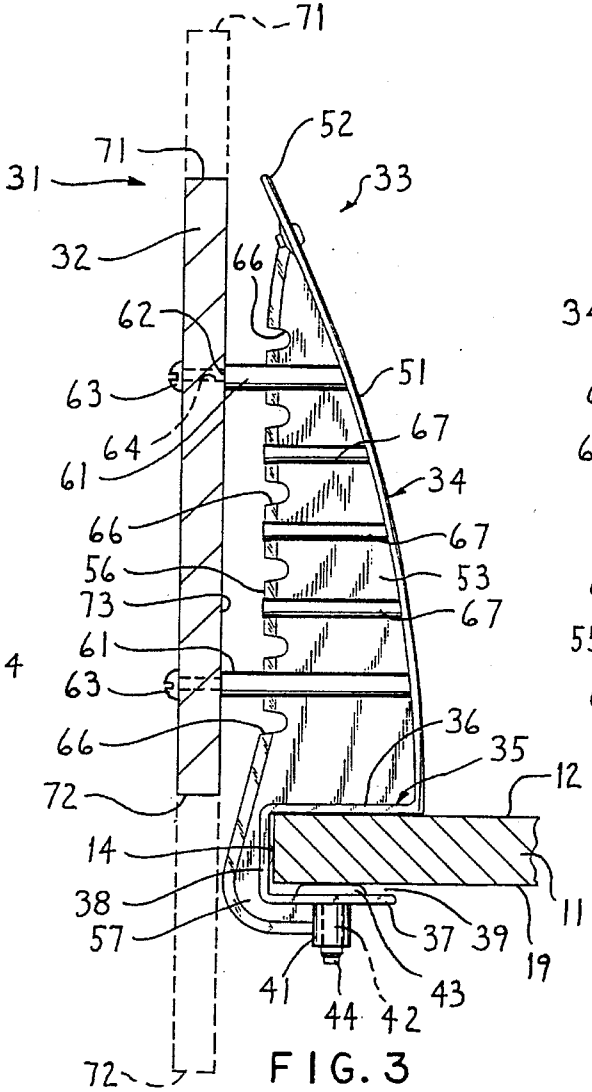
FIG. 3 is an enlarged fragmentary side elevational view, partially in cross-section, and taken generally along line 3—3 in FIG. 1.
Figure 2:
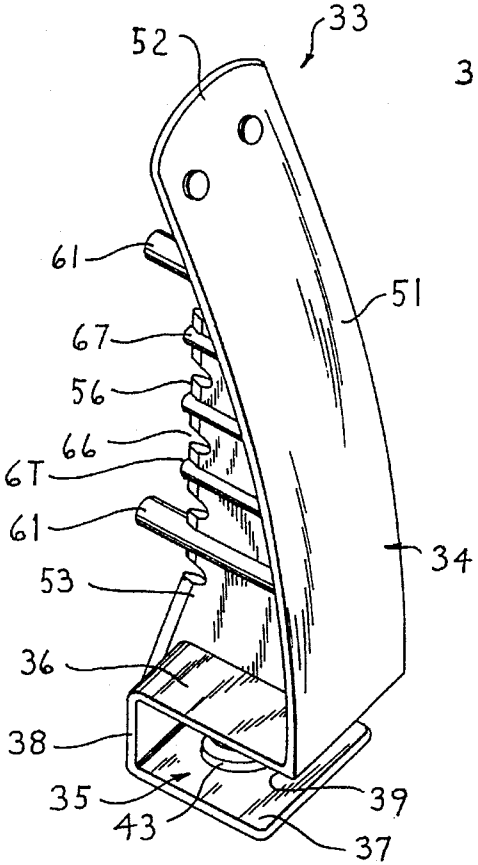
FIG. 2 is an enlarged perspective view of the bracket used for mounting the panel as appearing in FIG. 1.

As illustrated by FIG. 3, the screen 31 may be provided with upper and lower longitudinally extending horizontal edges 71 and 72, respectively, the upper edge in this embodiment being disposed in close proximity to the tips 52 of the brackets, and the lower edge 72 being disposed at an elevation which is similar to worksurface elevation. The size of the screen 31 can be significantly increased, however, either upwardly and/or downwardly. For example, the height of the screen 31 can increase so that the upper edge 71 is at a significantly higher elevation, such as indicated by dotted lines in FIG. 3. Alternatively, the screen can be of greater downward projection so that the lower edge 72 thereof is positioned below the worksurface, as indicated by dotted lines in FIG. 3, which illustrates that the screen 31 is disposed rearwardly of the rear edge 14 of the worksurface so as to permit its downward extension to provide additional privacy screening of the worksurface and of the region thereunder. The front surface 73 of the screen 31, however, is preferably disposed in a vertical plane which is spaced rearwardly from the rear edge 14 by a preselected distance so as to permit electrical power and/or telecommunication cables to be passed downwardly through the passage between the screen and the rear edge of the worksurface, such as for access to a cable trough 24 (FIG. 1) which is fixed to and extends horizontally between the legs at an elevation below the worksurface.

The second attachment structure associated with the upright support wall 53 includes a plurality of openings or recesses 66 which reject horizontally inwardly a short extent from the rear edge 56, these openings 66 being uniformly vertically spaced apart and terminating in substantially semi-cylindrical inner rounded ends. This second attachment arrangement also includes a plurality, three in the illustrated embodiment, of vertically spaced but horizontally elongated support hubs 67 which project rearwardly of the support wall and terminates substantially at the rear edge 56. In the illustrated embodiment the upper and lower ones of these support hubs 67 have openings extending inwardly from the rear free ends thereof, whereby these openings are adapted to receive therein securing screws 68 (FIG. 6) for permitting attachment of an upright panel 75 (FIGS. 6–8). The support hubs 67 are vertically uniformly spaced apart with respect to one another and with respect to the support hubs or studs 61, whereby one of the openings 66 is disposed between each adjacent pair of support hubs, and similarly each support hub 61 or 67 is disposed midway between each vertically adjacent pair of openings 66.

The upright panel 75 is formed as an open grid created by a plurality of horizontally elongate wire rods 76 disposed in vertically spaced but horizontally extending and parallel relationship. This plurality of horizontal rods 76 are rigidly joined by a transversely and vertically extending center cross rod 78, and a pair of mounting plates 78 which extend perpendicularly between and are rigidly joined to the rods 76 in the vicinity of opposite ends of the grid. Each plate 78 has a pair of vertically spaced guide openings 81 therethrough, which openings are positioned and sized so as to enable the support studs 61 to project therethrough and hence provide supportive engagement for the grid 75. In addition, the rods 76 project into the series of openings or recesses 66, whereby the plates 78 effectively abut against the rear edges 56 of the upright support plates 53. The grid 75 is then fixed in this position wherein it abuts the rear of the upright support plates by the screws 68 which extend through openings 82 formed in the plates 78 for threaded engagement within the openings formed in the upper and lower support hubs 67.

With the grid 75 mounted on the brackets 33, and with the brackets clampingly mounted on the rear edge portion of the worksurface, the grid 75 projects upwardly within a vertical plane which is approximately vertically aligned with the rear edge 14 as illustrated in FIG. 6. This grid 75 can then be utilized to permit other accessories or components to be supported therefrom, such as by being hung from the wire rods 75. Such components are conventional and well known in the office environment, and will not be described in detailed.

The panel arrangement of the present invention, when provided with the grid 75 thereon, can additionally be provided with the screen 31 if desired so as to provide a privacy backing behind the grid, such being indicated by dotted lines in FIG. 6. When both the grid panel 75 and the screen panel 31 are utilized, this results in the screen panel being spaced rearwardly a small distance from the grid panel so as to enable hooks associated with accessories to be hung onto the grid.

Referring now to FIGS. 9–12, there is a modified bracket supported panel arrangement according to the present invention. This modified arrangement includes a bracket 33' which incorporates many of the features of the bracket 33 described above, and accordingly corresponding parts of this modified bracket 33' are designated by the same reference as utilized above but are distinguished by addition of a prime (') thereto. These corresponding parts will not be further described.

This modified bracket 33' includes an upright front wall 91 which is of a generally V-shaped horizontal cross-section defined by side legs 92 which project rearwardly and angle sidewardly from a front apex. This V-shaped front wall projects rearwardly in generally enclosing relation to the upright support wall 53', the latter being fixed to the V-shaped front wall 91 substantially at the apex thereof and projecting rearwardly in generally bisecting relationship so that the rear edge of the upright support wall 53' is disposed rearwardly of the rear free edges of the side legs 92.

The V-shaped front wall 91 has the lower edge thereof fixed to the top wall 36' of the base channel part. This V-shaped front wall 91 projects vertically upwardly to a height slightly above the upper end of the upright support wall 53' and this upper free end has a V-shaped top plate 93 fixed thereto and defining a substantially horizontally enlarged upper mounting surface for permitting a shelf 96 or other similar structure to be fixedly mounted thereon. This mounting plate 93 has openings 94 therethrough for accommodating fasteners such as screws which project upwardly therethrough for engagement with the shelf 96.

To provide additional strength, the bracket has several horizontally extending reinforcing plates 95 joined between the sidewalls 92 and the upright support 53' in vertically spaced relation.

The modified bracket 33' functions in the same manner as the bracket 33 described above in that it permits either the screen 31 or the grid 75, or both, to be mounted rearwardly of a pair of such brackets so as to project upwardly adjacent the rear edge of a worksurface.

With the arrangement of this invention, the panel (such as screen 31 and/or grid 75) can initially be mounted on a pair of spaced brackets 33 or 33'. Thereafter the assembled arrangement can be positioned on the rear edge portion of the worksurface 11 by slipping the rear edge 14 thereof into the channels 39 of the brackets, with the clamping members 41 then being rotated so as to cause the buttons or pads to be moved upwardly into clamping engagement with the underside of the worksurface to effect secure clamping of the arrangement onto the worksurface. This can be accomplished not only easily and efficiently, but enables the arrangement to be mounted on any standard worksurface without requiring any special construction or modification of the worksurface.

The screen 31 of the invention will typically be formed similar to a tack board, such as by being constructed of a fiber board or the like having a suitable fabric thereof, to permit pins and the like to be inserted therein. Other suitable materials, including hard-faced materials, can be utilized for defining the screen.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a freestanding desk or table having an enlarged worksurface defining thereon an enlarged and substantially horizontally planar upper surface, said worksurface defining thereon a horizontally and longitudinally extending rear edge, and an upright bracket-supported panel arrangement mounted on said worksurface and projecting upwardly therefrom in the vicinity of said rear edge, the improvement wherein said arrangement comprises:

at least two upright brackets removably attached to said worksurface adjacent the rear edge thereof in longitudinally spaced relation therealong;

a horizontally elongated upright panel fixedly but removably attached to said brackets so that said panel is disposed adjacent said rear edge and projects upwardly relatively to said upper surface;

each said bracket including a lower generally C-shaped mounting part which defines a generally horizontally and forwardly opening channel for accommodating therein a rear edge portion of said worksurface, said C-shaped mounting part having a clamping member movably mounted thereon for effecting clamping engagement of the rear edge portion of the worksurface within said channel;

said bracket also including an upright part which is fixed to said mounting part and is cantilevered upwardly above said upper surface, said upright part including a vertically extending support wall defining thereon a back edge which projects vertically upwardly relative to said worksurface in the vicinity of the rear edge thereof; and first attachment parts provided on said support wall in vertically spaced relation along the back edge thereof for engagement with removable fastener means mounted on said panel for fixedly attaching said panel to said brackets so as to position said panel rearwardly of but adjacent said back edge of said support wall and with said panel extending horizontally between said brackets.

2. The arrangement of claim 1, wherein said first attachment parts includes at least two studs which are fixed to and project horizontally rearwardly in cantilevered relation beyond said back edge and terminate in abutment surfaces at rear free ends thereof for abutment against a front face of said panel so that said panel is disposed rearwardly a predetermined distance from said back edge of said brackets.

3. An arrangement according to claim 2, wherein said back edge of said brackets is approximately vertically aligned with the rear edge of said worksurface, and wherein a front surface of said panel fixedly attached to said back edge through said attachment parts is spaced a small horizontal distance rearwardly of the worksurface rear edge to define a downwardly opening clearance space therebetween.

4. An arrangement according to claim 1, wherein said support wall defines second attachment parts on the back edge thereof for alternative supportive engagement with a further panel having a configuration which is different from that of said first-mentioned panel.

5. An arrangement according to claim 4, wherein said second attachment parts include a plurality of notch-like recesses which open horizontally forwardly from the back edge of said support wall in vertically spaced relation therealong, and a second horizontally-elongated and vertically upright panel removably attached to the second attachment parts of said brackets, said second panel including a plurality of vertically spaced and horizontally elongate rods which are rigidly joined together with the individual rods projecting into and being supported within the recesses which define said second attachment parts.

6. An arrangement according to claim 5, wherein said first attachment parts includes at least two studs which are fixed to and project horizontally rearwardly in cantilevered relation beyond said back edge and terminate in abutment surfaces at rear free ends thereof for abutment against a front face of said first-mentioned panel so that said first-mentioned panel is disposed rearwardly a predetermined distance from said back edge of said brackets.

7. An arrangement according to claim 1, wherein said first attachment parts include a plurality of notch-like recesses which open horizontally forwardly from the back edge of said support wall in vertically spaced relation therealong, and said panel being removably attached to the first attachment parts of said brackets, said panel including a plurality of vertically spaced and horizontally elongate rods which are rigidly joined together with the individual rods projecting into and being supported within the recesses which define said first attachment parts.

8. An arrangement according to claim 1, wherein said upright part includes a front wall which projects vertically upwardly and is fixed to a front edge of said support wall, said front wall extending transversely in opposite horizontal directions from said vertical support wall and projecting vertically upwardly therealong so as to terminate in an upper free end.

9. An arrangement according to claim 8, wherein said front wall is horizontally flat and cooperates with the vertical support wall so as to define a generally T-shaped horizontal cross-section.

10. An arrangement according to claim 8, wherein said front wall is generally V-shaped in horizontal cross-section and opens rearwardly relative to the worksurface, said vertical support wall being positioned interiorly of the V-shaped front wall and having a front edge fixed to said front wall substantially at an apex of the V-shaped cross-section with said vertical support wall projecting rearwardly therefrom so as to terminate at said back edge.

11. An arrangement according to claim 10, wherein the V-shaped front wall at its upper free end defines thereon a horizontally enlarged support platform, and a horizontally enlarged shelf-like member positioned on top of and fixedly engaged with said support platform.

12. An upright bracket-supported panel arrangement mountable on a worksurface so as to project thereof upwardly therefrom in the vicinity of a rear edge thereof, said arrangement comprising:

at least two upright brackets for removable attachment to a worksurface adjacent a rear edge thereof;

a horizontally elongated upright panel fixedly but removably attached to said brackets so that said panel projects upwardly relatively to the work surface and extends longitudinally between said brackets;

each said bracket including a lower generally C-shaped mounting part which defines a generally horizontally and forwardly opening channel for accommodating therein a rear edge portion of the worksurface, said C-shaped mounting part having a clamping member movably mounted thereon for effecting clamping engagement of the rear edge portion of the worksurface;

said bracket also including an upright part which is fixed to said mounting part and is cantilevered upwardly, said upright part including a vertically extending support wall defining thereon a back edge which projects vertically; and first attachment parts provided on said support wall in vertically spaced relation along the back edge thereof for engagement with removable fastener means mounted on said panel for fixedly attaching of said panel to said brackets so as to position said panel rearwardly adjacent said back edge.

13. The arrangement of claim 12, wherein said first attachment parts includes at least two studs which are fixed to and project horizontally rearwardly in cantilevered relation beyond said back edge and terminate in abutment surfaces at rear free ends thereof for abutment against a front face of said panel so that said panel is disposed rearwardly a predetermined distance from said back edge of said brackets.

14. An arrangement according to claim 12, wherein said support wall defines second attachment parts on the back edge thereof for alternative supportive engagement with a further panel having a configuration which is different from that of said first-mentioned panel.

15. An arrangement according to claim 14, wherein said second attachment parts include a plurality of notch-like recesses which open horizontally forwardly from the back edge of said support wall in vertically spaced relation therealong, and a second horizontally-elongated and vertically upright panel removably attached to the second attachment parts of said brackets, said second panel including a plurality of vertically spaced and horizontally elongate rods which are rigidly joined together with the individual rods projecting into and being supported within the recesses which define said second attachment parts.

16. An arrangement according to claim 15, wherein said first attachment parts includes at least two studs which are fixed to and project horizontally rearwardly in cantilevered relation beyond said back edge and terminate in abutment surfaces at rear free ends thereof for abutment against a front face of said first-mentioned panel so that said first-mentioned panel is disposed rearwardly a predetermined distance from said back edge of said brackets.

17. An arrangement according to claim 12, wherein said first attachment parts include a plurality of notch-like recesses which open horizontally forwardly from the back edge of said support wall in vertically spaced relation therealong, and said panel being removably attached to the first attachment parts of said brackets, said panel including a plurality of vertically spaced and horizontally elongate rods which are rigidly joined together with the individual rods projecting into and being supported within the recesses which define said first attachment parts.

18. An arrangement according to claim 12, wherein said upright part includes a front wall which projects vertically upwardly and is fixed to a front edge of said support wall, said front wall extending transversely in opposite horizontal directions from said vertical support wall and projecting vertically upwardly therealong so as to terminate in an upper free end.

19. An arrangement according to claim 18, wherein said front wall is horizontally flat and cooperates with the vertical support wall so as to define a generally T-shaped horizontal cross-section.

20. An arrangement according to claim 18, wherein said front wall is generally V-shaped in horizontal cross-section and opens rearwardly relative to the worksurface, said vertical support wall being positioned interiorly of the V-shaped front wall and having a front edge fixed to said front wall substantially at an apex of the V-shaped cross-section with said vertical support wall projecting rearwardly therefrom so as to terminate at said back edge.

21. An arrangement according to claim 20, wherein the V-shaped front wall at its upper free end defines thereon a horizontally enlarged support platform, and a horizontally enlarged shelf-like member positioned on top of and fixedly engaged with said support platform.

* * * * *